US008601839B1

(12) United States Patent
Liu

(10) Patent No.: US 8,601,839 B1
(45) Date of Patent: Dec. 10, 2013

(54) DEADLOCKING DRAWER LOCK

(71) Applicant: Federal Lock Co., Ltd., Pingtung County (TW)

(72) Inventor: Tien-Kao Liu, Pingung County (TW)

(73) Assignee: Federal Lock Co., Ltd., Pingtung County (TW)

( * ) Notice: Subject to any disclaimer, the term of this patent is extended or adjusted under 35 U.S.C. 154(b) by 0 days.

(21) Appl. No.: 13/664,765

(22) Filed: Oct. 31, 2012

(51) Int. Cl.
*E05B 65/46* (2006.01)

(52) U.S. Cl.
USPC .... 70/86; 70/107; 70/134; 70/150; 70/151 R; 70/379 R; 292/169.13; 292/169.14

(58) Field of Classification Search
USPC ..... 70/134, 107–111, 77–87, 150, 151 R, 70/151 A, 152, 153, 141, 144, 379 R, 70/379 A, 380, 418; 292/169.13, 169.14
See application file for complete search history.

(56) References Cited

U.S. PATENT DOCUMENTS

| | | | | | |
|---|---|---|---|---|---|
| 2,124,897 | A * | 7/1938 | Shaw | 70/151 R |
| 2,293,645 | A * | 8/1942 | Falk | 70/151 R |
| 2,787,155 | A * | 4/1957 | O'Connell | 70/156 |
| 4,848,118 | A * | 7/1989 | Tesone | 70/419 |
| 5,044,182 | A * | 9/1991 | Totten | 70/143 |
| 5,201,200 | A * | 4/1993 | Hauber | 70/107 |
| 5,657,652 | A * | 8/1997 | Martin | 70/85 |
| 5,927,769 | A * | 7/1999 | Pullen | 292/169.13 |
| 7,874,189 | B2 * | 1/2011 | Martin | 70/85 |
| 2009/0211317 | A1 * | 8/2009 | Kondratuk | 70/107 |
| 2009/0229322 | A1 * | 9/2009 | Chou | 70/107 |

* cited by examiner

*Primary Examiner* — Lloyd Gall

(74) *Attorney, Agent, or Firm* — Rosenberg, Klein & Lee

(57) ABSTRACT

A drawer lock includes a housing with a cam received therein and the cam has a driving member. A deadlocking bolt in the housing has a driven member which is located so that it can be contacted by the driving member. A main bolt located in the housing and is driven by the cam. The main bolt has a stop portion which can be contacted by the driving member. The main bolt has an engaging stepped face. When the deadlocking bolt is pushed down responsive to closing the drawer, the driven member is engaged with the engaging stepped face by a bias force of a resilient member so that the drawer lock cannot be unlocked. When the cam rotates in one direction, the driving member contacts the stop portion to position the main bolt so that the drawer is not locked unintentionally.

5 Claims, 10 Drawing Sheets

DEADLOCKING DRAWER LOCK

FIELD OF THE INVENTION

The present invention relates to a drawer lock, and more particularly, to a deadlocking drawer lock which provides high safety feature.

BACKGROUND OF THE INVENTION

The conventional drawer lock is used to lock the drawer so as to protect the important goods or documents in the drawer. The thief does not damage the key plug of the lock directly, and instead, uses a strong plate-like member to directly push the curved portion of the key plug which is pushed by the plate-like member and retracted so as to open the drawer.

FIG. 1 shows the drawer lock 10 disclosed in U.S. Pat. No. 5,657,652 and generally comprises a main bolt 20 and a deadlocking bolt 30. A spring 201 is located between the inner end of the housing of the lock 10 and the main bolt 20. The main bolt 20 has a stepped face 202 and the deadlocking bolt 30 is connected with a locking arm 40 which has a hole 401 through which a pin 301 extends to connect the deadlocking bolt 30 and the locking arm 40. A resilient member 302 is located between the deadlocking bolt 30 and the locking arm 40 and another resilient member 303 is locked between the deadlocking bolt 30 and the inner end of the housing. The locking arm 40 contacts the main bolt 20 when the main bolt 20 is forced to retract. A cam 50 is located in the housing and co-rotatably connected to the key plug. The cam 50 has a protrusion 501 and a push portion 502, wherein the protrusion 501 is located to be displaceable into contact with the stepped face 202 and the push portion 502 is located to displace the locking arm 40 responsive to rotation of the cam 50. As shown in FIG. 2, when the cam 50 rotates in one direction, the push portion 502 pushes the locking arm 40 to be separated from the main bolt 20. The protrusion 501 contacts the stepped face 202 and the main bolt 20 moves toward the spring 201 to unlock the lock.

The user usually pushes the drawer slightly and the main bolt 20 and the deadlocking bolt 30 are not engaged in the recess of the cabinet when the drawer is not opened. However, the main bolt 20 and the deadlocking bolt 30 protrude from the housing of the lock 10 by the spring 201 and the resilient member 303 so that the main bolt 20 and the deadlocking bolt 30 are easily pushed to compress the spring 201 and the resilient member 303 and inserted into the recess of the cabinet. The user has to rotate the key plug (unlock the lock) to open the drawer again. This is not convenient for the user. Besides, if the key is put in the drawer and the drawer is unintentionally locked, the user has to call a locksmith, otherwise, the drawer lock has to be damaged to open the drawer. Extra expense is required.

The present invention intends to provide a drawer lock which improves the shortcomings of the conventional drawer lock.

SUMMARY OF THE INVENTION

The present invention relates to a drawer lock and comprises a housing having a cam received therein and the cam has a driving member connected in radial direction of the cam. A deadlocking bolt is located in the housing and biased at one end by a resilient member so as to contact the housing. The deadlocking bolt is biased and protrudes beyond the housing. The deadlocking bolt has a recess defined in one side thereof and a driven member is located in the recess. The driven member is displaceable to a position where it can be contacted by the driving member. A resilient member is biased between the driven member and an inside of the recess. A main bolt is located in the housing and a resilient unit biases one end of the main bolt so that the main bolt contacts the inside of the housing. The main bolt is biased and protrudes beyond the housing. The main bolt is located in proximity to the cam which drives the main bolt to move vertically. The main bolt has a stop portion which is contacted by the driving member responsive to rotation of the cam. The main bolt has an engaging stepped face that is engageable by the driven member.

When the top of the main bolt and the top of the deadlocking bolt are flush with each other, the driven member is biased by the resilient member and contacts a side face of the main bolt. When the deadlocking bolt is pushed downward by displacement of the drawer with the drawer lock into a cabinet, the driven member will engage the engaging stepped face by the resilient member when the main bolt is positioned in a recess in the cabinet. When the driving member is displaced by the cam, when rotated in one direction, the driven member is displaced thereby and thereby is separated from the engaging stepped face. When the cam rotates in the opposite direction, the driving member contacts the stop portion to position the main bolt.

Preferably, the housing has a stop block and the deadlocking bolt has a slide slot in which the stop block is disposed to restrict movement of the deadlocking bolt.

Preferably, the cam has a push portion and the main bolt has a guide slot located so that the push portion of the cam can contact the guide slot. The deadlocking bolt has a first face that can be contacted by the push portion of the cam. The driven member has a second face that also can be contacted by the push portion of the cam.

Preferably, the driven member has a stop that can contact a side face of the main bolt. When the deadlocking bolt is pushed by the cabinet when the drawer is pushed closed, the driven member is engaged with the engaging stepped face and the stop contacts the side face of the main bolt.

Preferably, the recess has a groove that can be contacted by the stop so as to restrict movement of the driven member.

Preferably, the housing has a positioning portion and the main bolt has a restriction portion that can contact the positioning portion so as to restrict movement of the main bolt.

Preferably, the main bolt has an engaging slot and the resilient unit is biased between the engaging slot and the housing.

Preferably, the cam is coupled to a key plug. The key plug extends through the housing and rotatably drives the cam.

Preferably, the key plug has at least one transmission unit which is connected to the cam so as to synchronously rotate the cam with movement of the key plug.

The primary object of the present invention is to provide a drawer lock which improves the shortcomings of the conventional drawer lock which does not have a mechanism to prevent the main bolt and the deadlocking bolt from being locked unintentionally by pushing the main bolt and the deadlocking bolt down, as when the drawer is closed.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
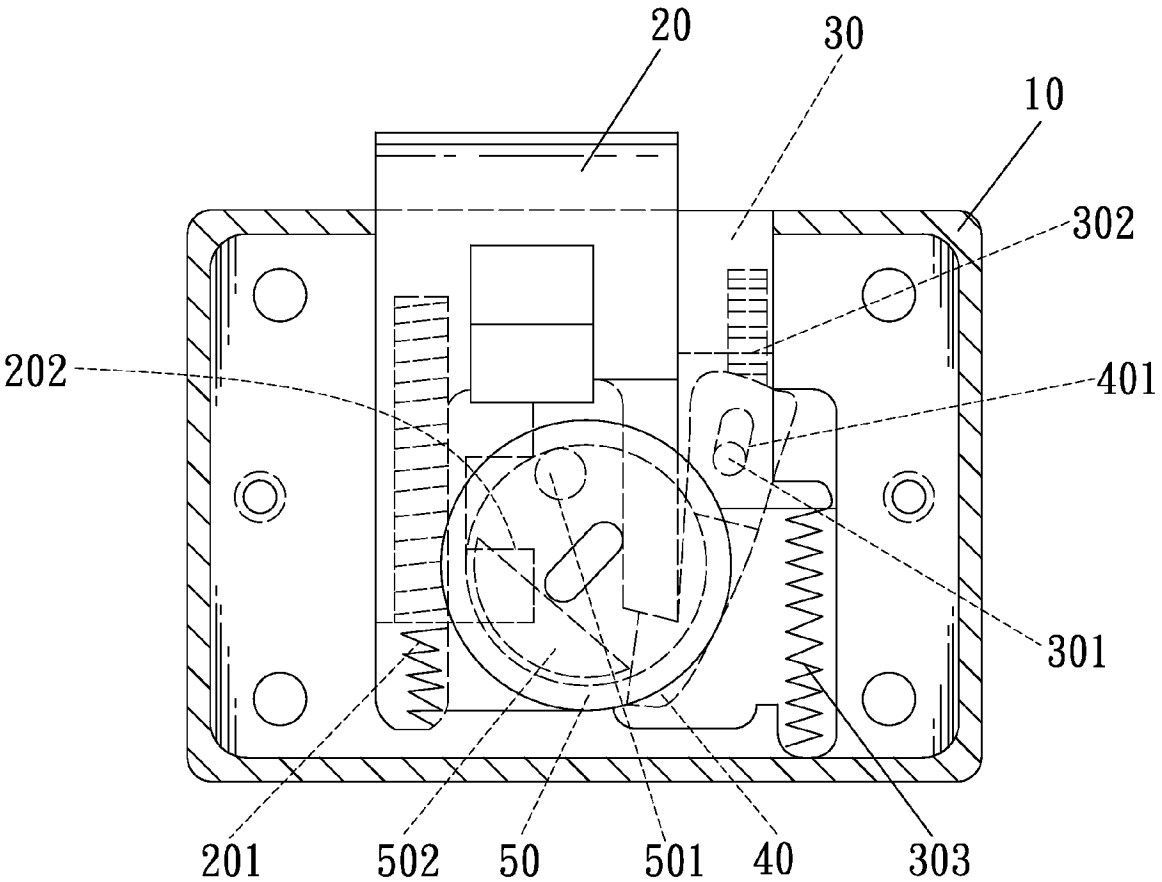
FIG. 1(PRIOR ART)
FIG. 1 shows a conventional drawer lock.
Figure 2:
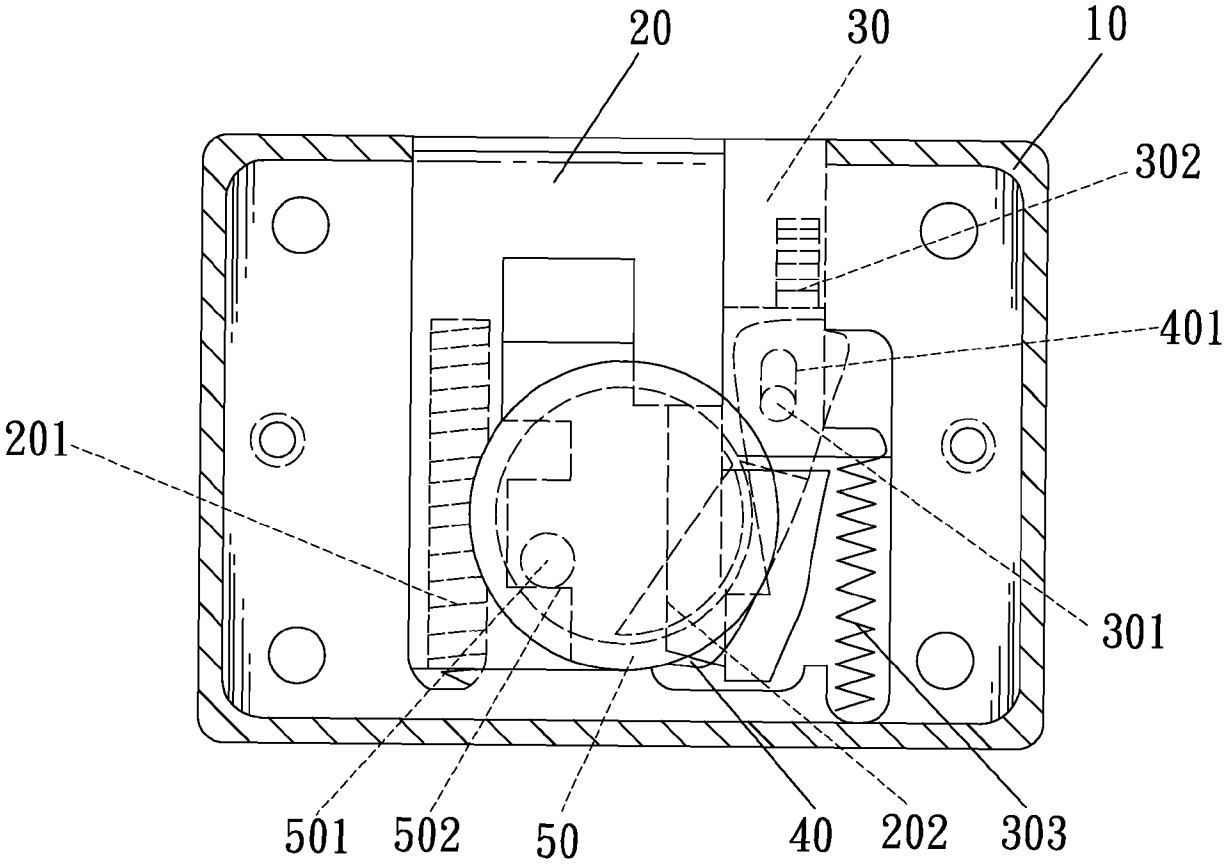
FIG. 2(PRIOR ART)
FIG. 2 shows that the conventional drawer lock is locked.
Figure 3:
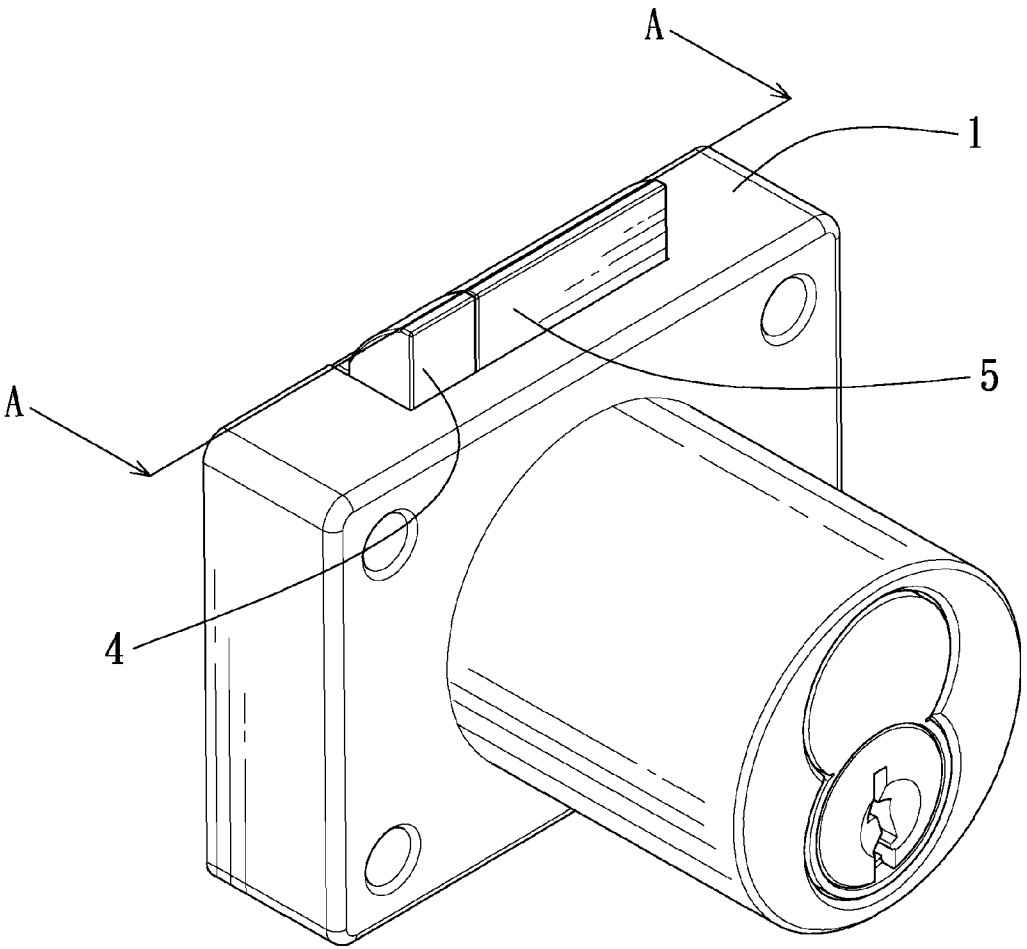
FIG. 3 is a perspective view to show the drawer lock of the present invention.
Figure 4:
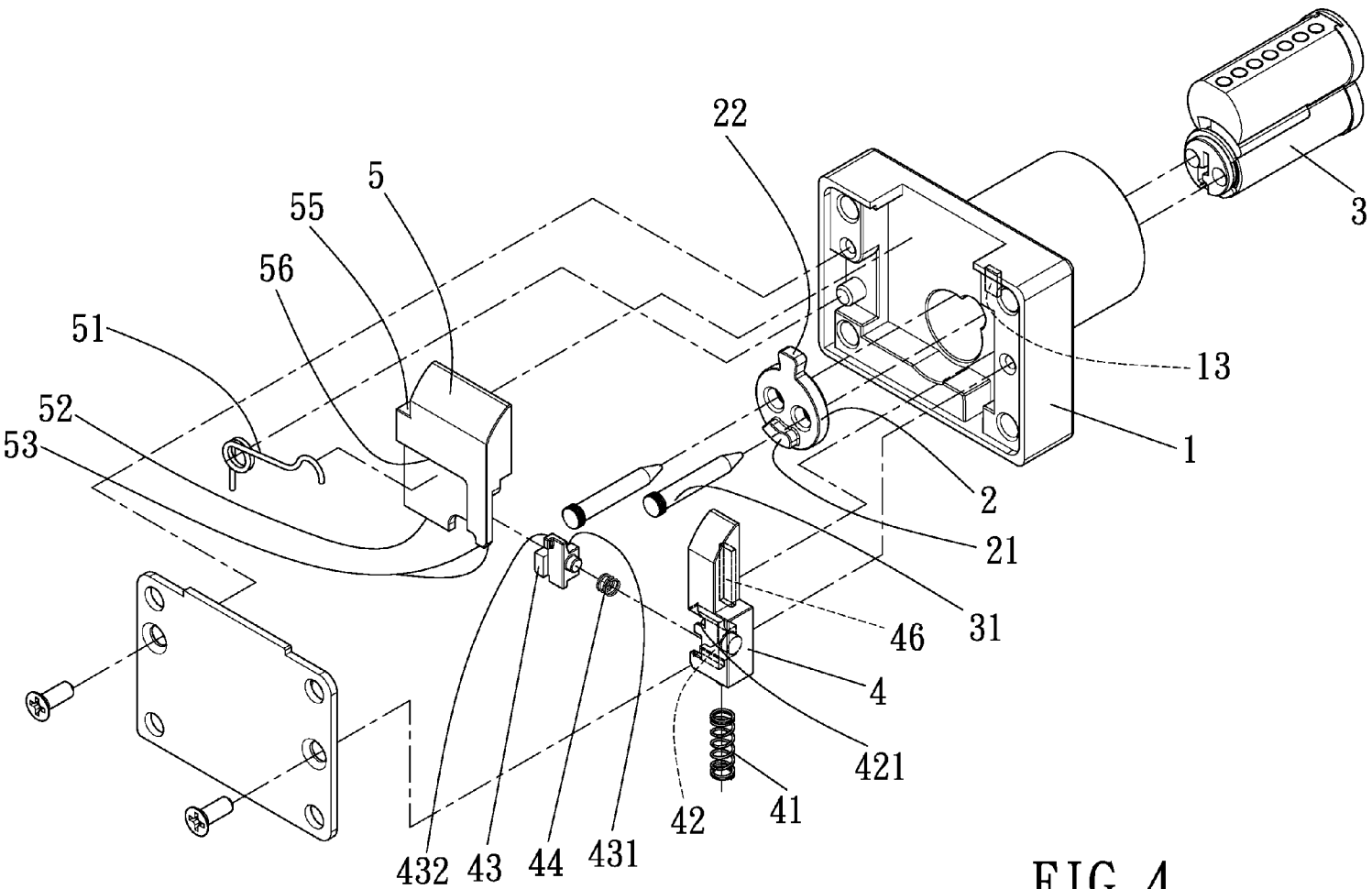
FIG. 4 is an exploded view to show the drawer lock of the present invention.
Figure 5:
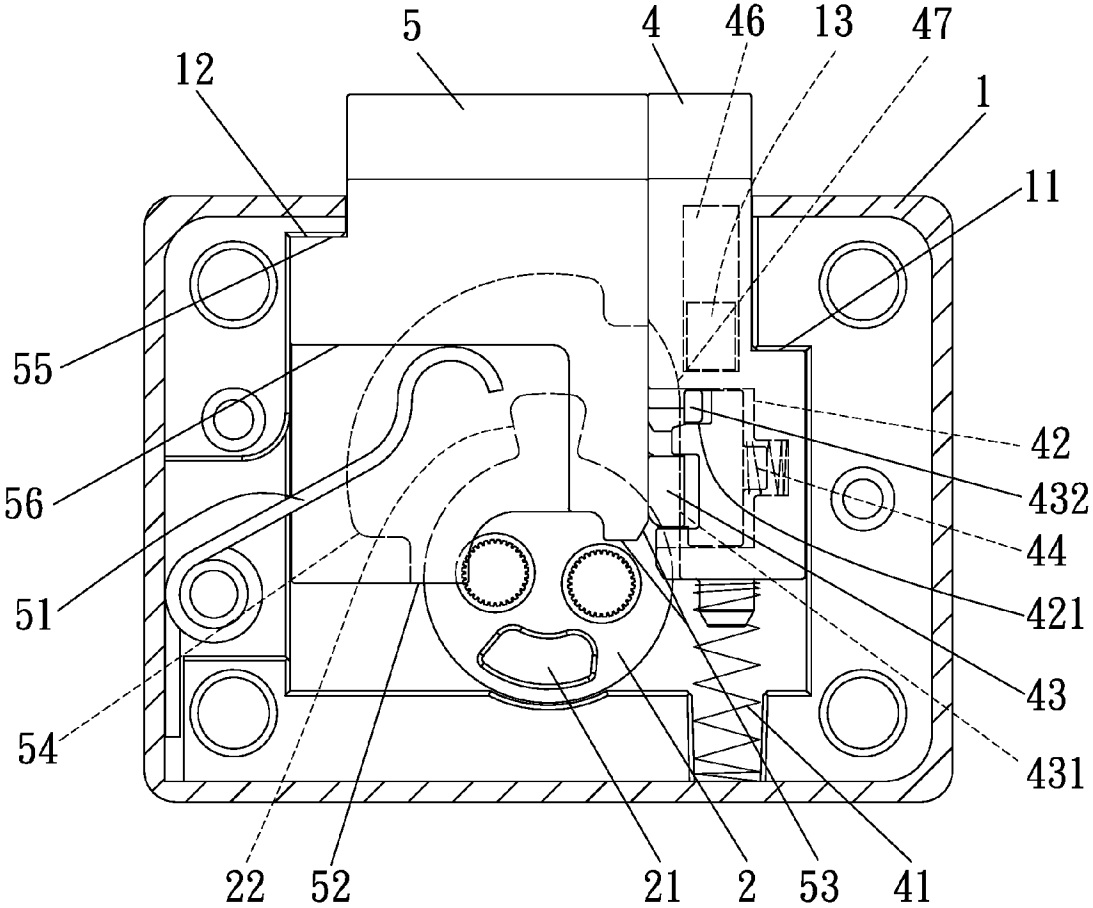
FIG. 5 is a cross sectional view taken along line A-A in FIG. 3.

Referring to FIGS. 3 to 5, the drawer lock of the present invention comprises a housing 1 having a first positioning portion 11, a second positioning portion 12 and a stop block 13. Disposed within the housing 1 is a lock cylinder having a rotatable key plug 3. A cam 2 is received in the housing 1 and has a driving member 21 protruding from one side of the cam 2 and extends along a perimeter portion thereof. The cam 2 has a radially extended push portion 22. The key plug 3 is axially aligned with the cam 2 and coupled thereto by at least one transmission unit 31 connected therebetween to synchronously rotate the cam 2 responsive to rotative movement of the key plug 3.

A deadlocking bolt 4 is located in the housing 1 and biased at one end by a resilient member 41 so as to contact the housing 1. The deadlocking bolt 4 is biased and a portion thereof protrudes beyond the housing 1. The deadlocking bolt 4 has a recess 42 defined in one side thereof and a driven member 43 is located in the recess 42. The driven member 43 is located so that it can be contacted by the driving member 21. A resilient member 44 is disposed between the driven member 43 and one inside of the recess 42 so as to outwardly bias the driven member 43 relative to the deadlocking bolt 4 within the recess 42. The housing 1 has a first positioning portion 11 and the deadlocking bolt 4 has a slide slot 46 which receives the stop block 13 therein to restrict movement of the deadlocking bolt 4. The deadlocking bolt 4 has a first face 47 that can be contacted by the push portion 22 of the cam 2. The driven member 43 has a second face 431 that can also be contacted by the push portion 22 of the cam 2.

A main bolt 5 is located in the housing 1 and a resilient unit 51 biases one end of the main bolt 5 so that the main bolt 5 contacts the inside of the housing 1. The main bolt 5 is biased and a portion thereof protrudes beyond the housing 1. The main bolt 5 is located in proximity to the cam 2 which drives the main bolt 5 to move vertically. The main bolt 5 has a stop portion 52 which is located so that it can be contacted by the driving member 21. The main bolt 5 has an engaging stepped face 53 which can be contacted by the driven member 43. The main bolt 5 has a guide slot 54 located so that the push portion 22 of the cam 2 can contact the guide slot 54. The driven member 43 has a stop 432 that can contact a side face of the main bolt 5. When the deadlocking bolt 4 is pushed down as the drawer in which the lock is installed is closed and the main bolt 5 engages the cabinet for the drawer, the driven member 43 engages the engaging stepped face 53 and the stop 432 contacts the side face of the main bolt 5 to prevent the driven member 43 from being separated from the recess 42. The recess 42 has a groove 421 that can be contacted by the stop 432 so as to restrict movement of the driven member 43. The main bolt 5 has a restriction portion 55 which contacts the second positioning portion 12 so as to restrict movement of the main bolt 5. The main bolt 5 has an engaging slot 56 which is contacted by the resilient unit 51 for applying a bias force between the main both 5 and the housing 1.

Figure 6:
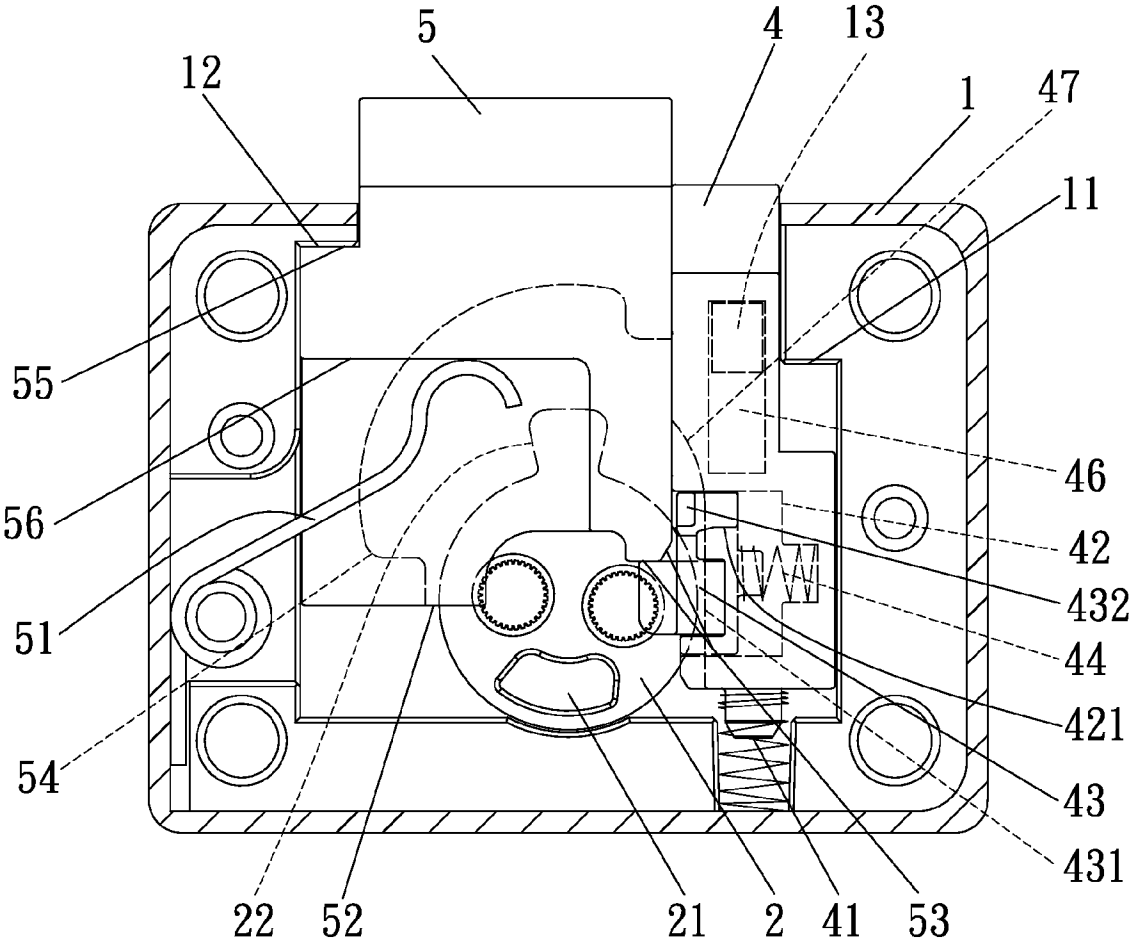
FIG. 6 shows that the drawer lock of the present invention is locked.

As shown in FIG. 5, when the top of the main bolt 5 and the top of the deadlocking bolt 4 are flush with each other, the driven member 43 is biased by the resilient member 44 and contacts the side face of the main bolt 5 and the key plug 3 is located at the initial position. As shown in FIG. 6, the drawer lock is locked, the deadlocking bolt 4 is pushed down by the drawer having been closed and the cabinet for the drawer thereby pushing down the deadlocking bolt 4. When the drawer is closed, the main bolt will be biased upward by the resilient unit 51 to engage a recess in the cabinet and the driven member 43 will be released from its contact with the side face of the main bolt 5 and is biased to be displaced to engage the engaging stepped face 53 by the resilient member 44 to thereby secure the position the main bolt 5, which then cannot move downwardly. Therefore, the drawer lock cannot be unlocked by an attempt to then pry the main bolt 5. Under this circumstance, the stop 432 engages the side face of the main bolt 5 to prevent the driven member 43 from being separated from the recess 42.

Figure 7:
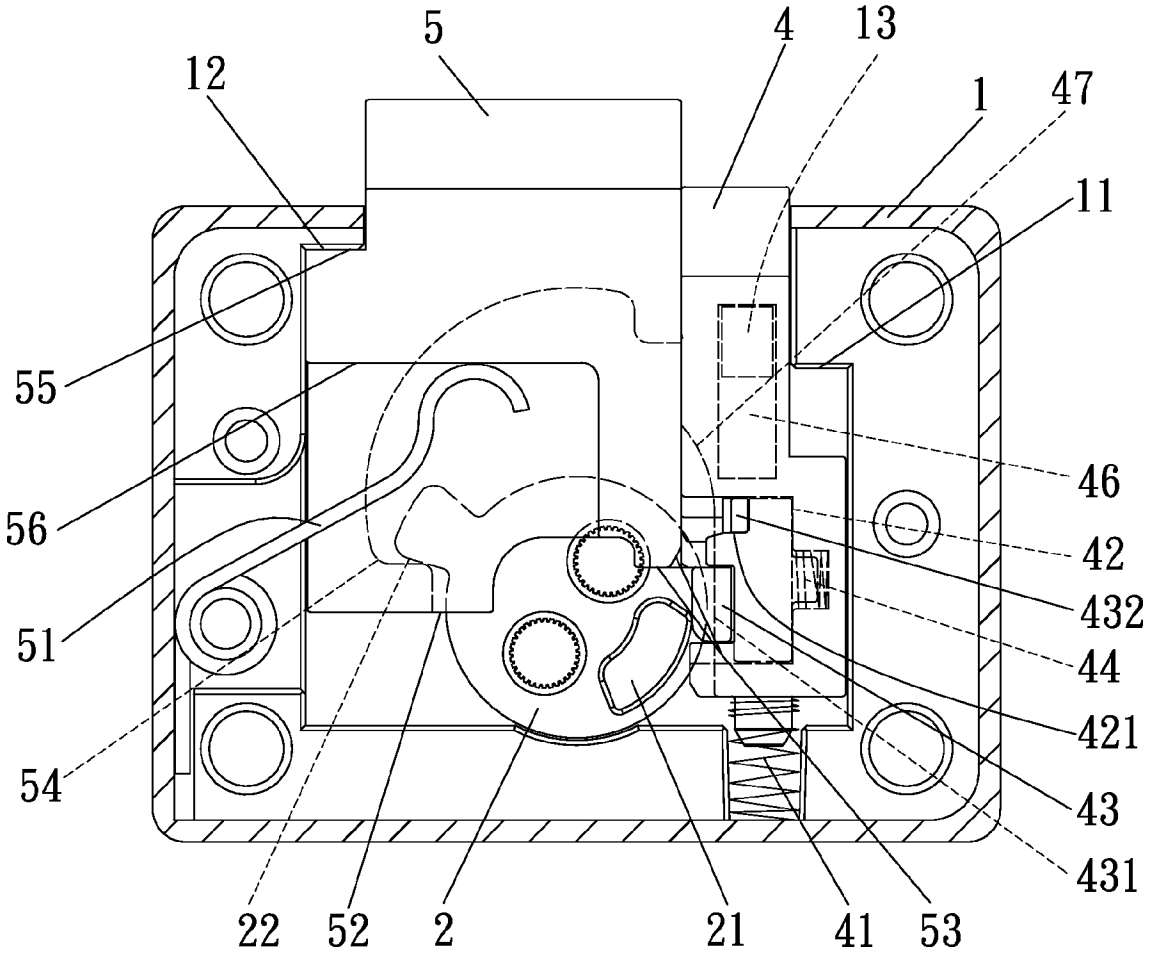
FIG. 7 shows that the drawer lock of the present invention is unlocked.
Figure 8:
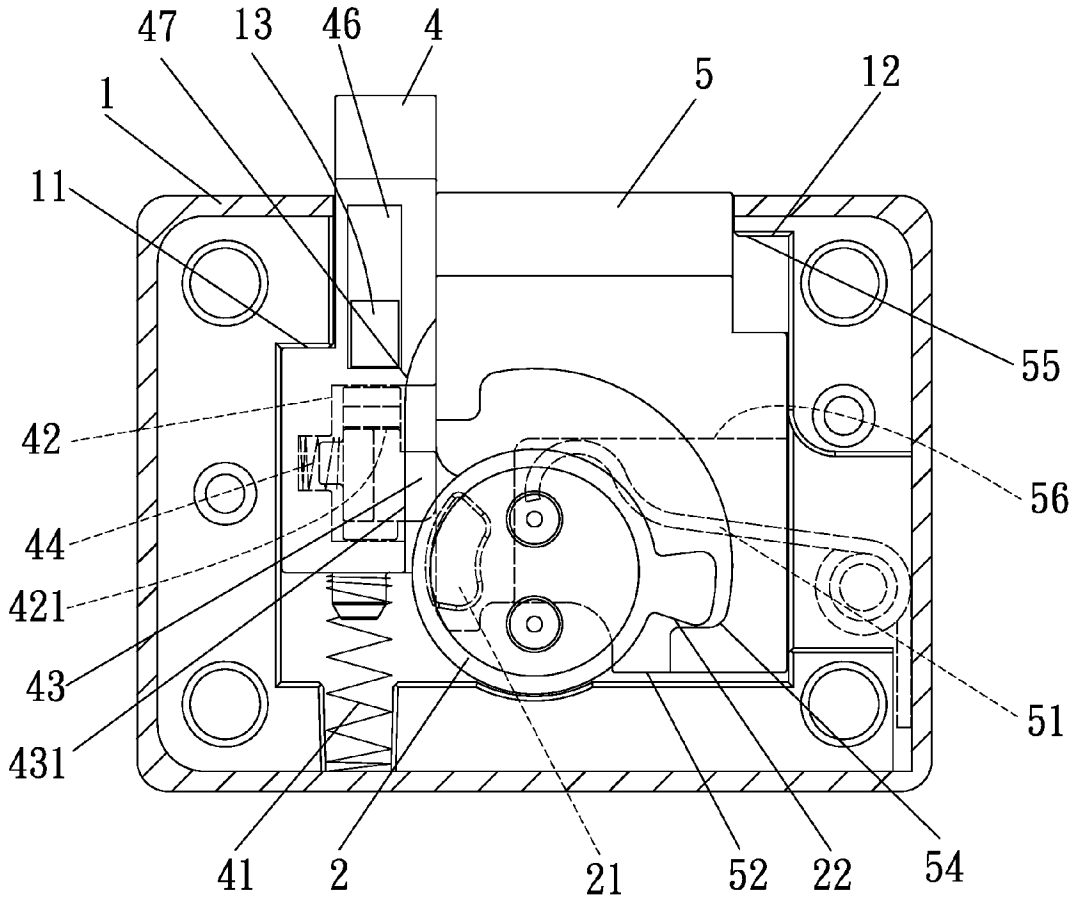
FIG. 8 shows another view of the drawer lock of the present invention in unlocked status.

When unlocking the drawer lock, a key is inserted into the key plug 3 and rotates it, as shown in FIG. 7, the transmission unit 31 drives the cam 2 to rotate with the rotation of the key plug 3 and the driving member 21 is displaced with the cam 2 and displaceably contacts the driven member 43. The driven member 43 is displaced into the recess 42 and compresses the resilient member 44. The displacement of the driven member 43 from its engagement with the engaging stepped face 53 releases the deadlocking bolt 4 to move upward under the bias force of resilient member 41 as the drawer is pulled open, and the driven member 43 then engages the side face of the main bolt 5. As shown in FIG. 8, the push portion 22 of the cam 2 contacts the guide slot 54 of the main bolt 5 and displaces the main bolt 5 to compress the resilient unit 51, so that the drawer lock can be unlocked and the drawer pulled open. When the key plug 3 returns to the initial position, the main bolt 5 is biased by the resilient unit 51 which is in contact with the engaging slot 56 to displace the main bolt 5 back to its initial position.

Figure 9:
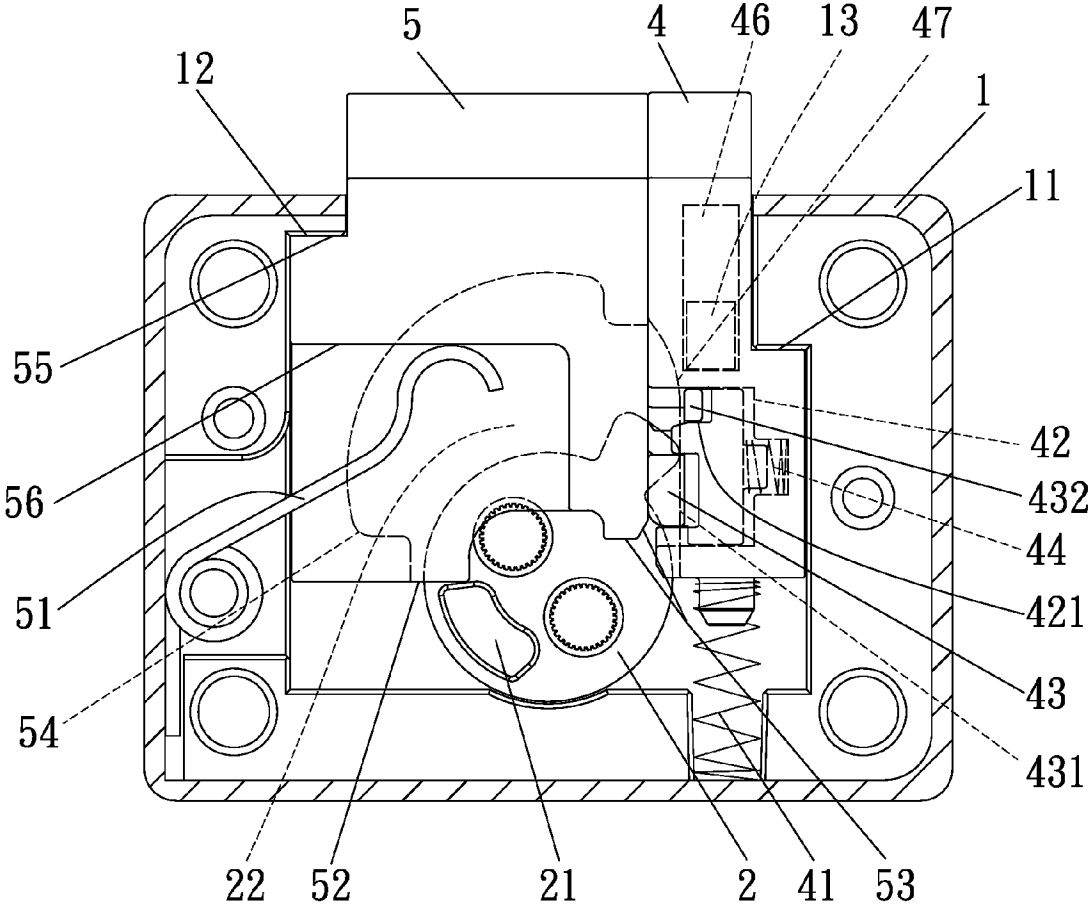
FIG. 9 shows that the cam of the drawer lock of the present invention is rotated to one direction.
Figure 10:
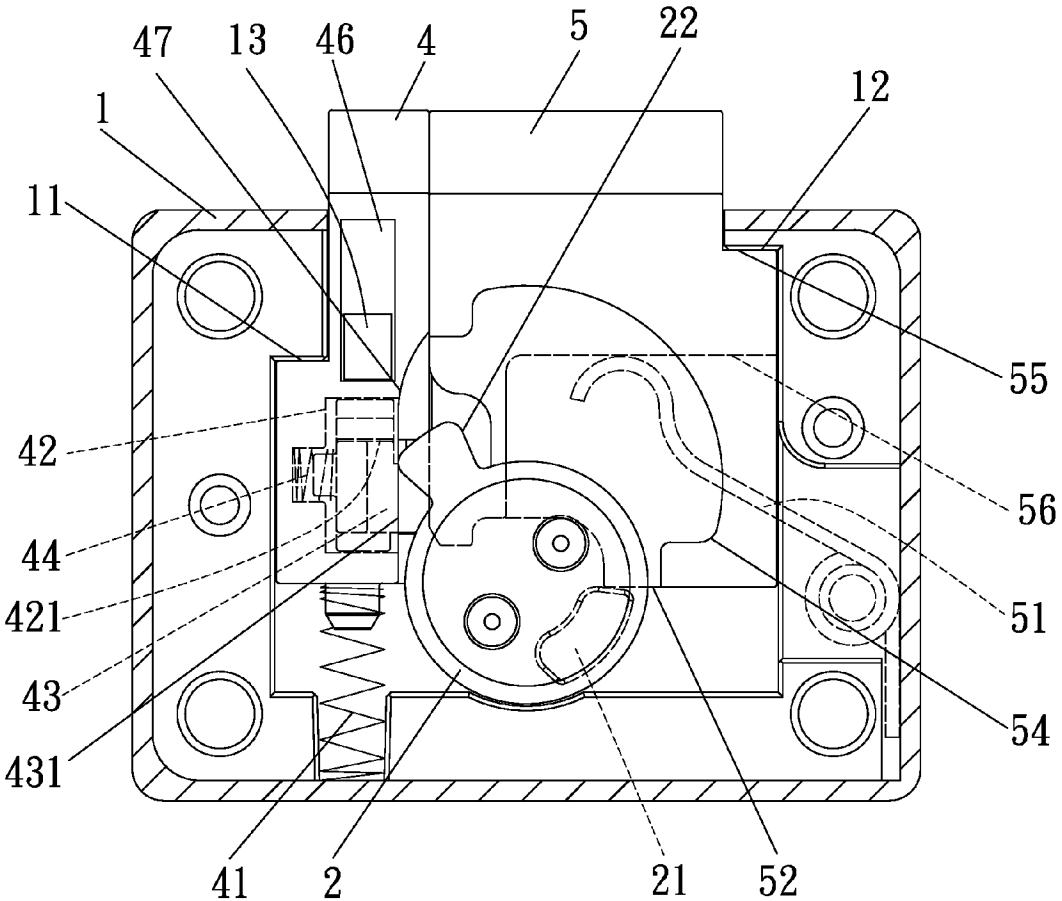
FIG. 10 shows that the cam of the drawer lock of the present invention is rotated to another direction.

As shown in FIG. 9, when the cam 2 rotates in an opposite direction, the driving member 21 contacts the stop portion 52 to fix the position of the main bolt 5, which then cannot move to compress the resilient unit 51. As shown in FIG. 10, the deadlocking bolt 4 has a first face 47 and the driven member 43 has a second face 431, so that the deadlocking bolt 4 and the driven member 43 are not hit by the push portion 22, when the cam 2 is rotated to fix the position of the main bolt 5. Accordingly, when the drawer is pushed to be closed, the main bolt 5 cannot lock the drawer since the contact between the driving portion 21 and the stop portion 52 prevents any downward displacement of the main bolt 5, and in this position of the key plug 3 the key cannot be removed from the key plug 3 which is located at the unlocked status. Therefore, the situation that the user forgets the key in the drawer and the drawer is unintentionally locked will not happen.

When the drawer lock is locked, the deadlocking bolt 4 is depressed and the driven member 43 is biased by the resilient member 44 to engage with the engaging stepped face 53, so that the main bolt 5 is fixed in position and cannot move, so that the thief cannot push or shift the main bolt 5 by using a plate-like member to unlock the drawer lock. The driven member 43 thereby provides a safety feature.

When the cam 2 rotates to the opposite direction, the driving member 21 contacts the stop portion 52 of the main bolt 5 and the main bolt 5 is positioned to its upward extent, and the key cannot be removed from the key plug 3 when the key plug 3 is not located at the initial position, so that the user cannot forget or leave the key in the drawer. Therefore, the situation that the key is left in the drawer and the drawer lock is unintentionally locked cannot happen.

While we have shown and described the embodiment in accordance with the present invention, it should be clear to those skilled in the art that further embodiments may be made without departing from the scope of the present invention.

What is claimed is:

1. A drawer lock comprising:

a housing having a key plug rotatably disposed therein;

a cam received in the housing and coupled to the key plug for rotation therewith, the cam having a driving member disposed along a perimeter portion thereof and protruding from one side of the cam and a push portion extending radially therefrom;

a deadlocking bolt being longitudinally slidably disposed in the housing and being biased at one longitudinal end thereof by a first resilient member so as to have a portion thereof protruding through an opening in the housing to extend therefrom, the deadlocking bolt having a recess defined in a side thereof and extending transversely with respect to the longitudinal direction;

a driven member slidably disposed in the recess, the driven member being biased outwardly from the side of the deadlocking bolt by a second resilient member located between the driven member and the deadlocking bolt, the driven member being located to be contacted by the driving member responsive to rotation of the cam in a first direction; and a main bolt being longitudinally slidably disposed in the housing adjacent to the deadlocking bolt, the main bolt being biased by a resilient unit so that a portion of the main bolt extends through the opening in the housing, the main bolt having a guide slot portion located to be contacted by the push portion responsive to rotation of the cam for driving the main bolt to move longitudinally against the bias of the resilient unit, the main bolt having a stop portion which is located to be contacted by the driving member responsive to rotation of the cam in a second direction, the second direction being opposite the first direction, the main bolt having an engaging stepped face which is positioned to be contacted by the driven member responsive to the portion of the main bolt extending from the housing and the deadlocking bolt being displaced into the housing against the bias of the first resilient member;

wherein, when a top of the portion of the main bolt and a top of the portion of the deadlocking bolt are flush with each other, the driven member is held within the recess of the deadlocking bolt against the bias of the second resilient member by contact with a side face of the main bolt, when the deadlocking bolt is pushed longitudinally so that the portion thereof is displaced into the housing while the portion of the main bolt extends from the housing, the driven member biased by the second resilient member engages the engaging stepped face of the main bolt to thereby block longitudinal displacement of the main bolt into the housing, and subsequently, when the driving member is displaced by rotation of the cam in the first direction to contact the driven member and displace the driven member into the recess against the bias of the second resilient member to thereby be separated from the engaging stepped face, rotation of the cam in the first direction positions the push portion thereof into contact with the guide slot portion to longitudinally displace the main bolt against the bias of the resilient unit; and wherein, responsive to rotation of the cam in the second direction, the driving member is displaced into contact with the stop portion of the main bolt to thereby block longitudinal displacement of the main bolt for preventing inadvertent locking of the drawer lock.

2. The drawer lock as claimed in claim 1, wherein the housing has a stop block protruding from an internal face thereof and the deadlocking bolt has a slide slot formed therein into which the stop block is slidingly received to restrict longitudinal movement of the deadlocking bolt.

3. The drawer lock as claimed in claim 1, wherein the driven member has a stop which is located to contact the side face of the main bolt to limit displacement of the driven member when the driven member is engaged with the engaging stepped face of the main bolt.

4. The drawer lock as claimed in claim 3, wherein the recess has a groove which is located to be contacted by the stop to limit displacement of the driven member against the bias of the second resilient member.

5. The drawer lock as claimed in claim 1, wherein the main bolt has an engaging slot in which the resilient unit extends to contact the main bolt.

* * * * *